US007320474B2

(12) United States Patent
Quellais et al.

(10) Patent No.: US 7,320,474 B2
(45) Date of Patent: Jan. 22, 2008

(54) DEVICE FOR BINDING A BOOT TO A SPORTS ARTICLE

(75) Inventors: Jacques Quellais, Saint-Jorioz (FR); Bruno Lancon, Villy le Pelloux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 11/229,719

(22) Filed: Sep. 20, 2005

(65) Prior Publication Data

US 2006/0012152 A1 Jan. 19, 2006

Related U.S. Application Data

(63) Continuation of application No. 10/759,211, filed on Jan. 20, 2004, now Pat. No. 6,964,428.

(30) Foreign Application Priority Data

Jan. 21, 2003 (FR) ..... 03 00811

(51) Int. Cl.
*A63C 9/18* (2006.01)

(52) U.S. Cl. ..... 280/615; 280/613

(58) Field of Classification Search ..... 280/615, 280/613, 614, 634, 631, 632; 36/117.2
See application file for complete search history.

(56) References Cited

U.S. PATENT DOCUMENTS 2,158,599 A 5/1939 Weber ..... 280/614
2,172,669 A 9/1939 Taft ..... 280/614
2,246,153 A * 6/1941 Wallace ..... 280/614
2,400,065 A * 5/1946 Beerli ..... 280/614
3,844,575 A 10/1974 Salomon ..... 280/11.35 N
3,863,942 A 2/1975 Burger ..... 280/11.35 Z
4,079,962 A 3/1978 Frechin ..... 280/613
4,273,355 A * 6/1981 Storandt ..... 280/614
4,949,988 A * 8/1990 Rousset et al. ..... 280/615
5,085,454 A 2/1992 Provence et al. ..... 280/615
5,152,546 A * 10/1992 Dunand et al. ..... 280/615
5,190,310 A * 3/1993 Hauglin et al. ..... 280/615
5,213,359 A * 5/1993 Girard ..... 280/615
5,224,729 A * 7/1993 Provence et al. ..... 280/615
5,224,730 A * 7/1993 Provence et al. ..... 280/615
5,228,714 A * 7/1993 Dekanovsky ..... 280/615
5,366,235 A 11/1994 Eugler et al. ..... 280/622
5,669,622 A * 9/1997 Miller ..... 280/615
5,671,941 A * 9/1997 Girard ..... 280/615

(Continued)

FOREIGN PATENT DOCUMENTS

CH 623483 6/1981

(Continued)

*Primary Examiner*—J. A Shriver
(74) *Attorney, Agent, or Firm*—Greenblum & Bernstein, P.L.C.

(57) ABSTRACT

A device for binding a boot to a cross-country ski, the device fixing the front of the boot to the ski while allowing the rear of the boot to move relative to the ski between a low position and a high position. The device includes an elastic return system for applying an elastic return force to return the boot to the low position, and an elastic abutment operable at the end of travel of the boot toward the high position.

33 Claims, 8 Drawing Sheets

U.S. PATENT DOCUMENTS

| | | | | |
|---|---|---|---|---|
| 5,924,719 | A * | 7/1999 | Girard | 280/615 |
| 5,944,337 | A * | 8/1999 | Girard et al. | 280/615 |
| 6,017,050 | A * | 1/2000 | Girard | 280/615 |
| 6,105,993 | A | 8/2000 | Gignoux | 280/613 |
| 6,113,111 | A | 9/2000 | Gierveld et al. | 280/11.15 |
| 6,152,458 | A | 11/2000 | Edauw et al. | 280/11.14 |
| 6,209,903 | B1 * | 4/2001 | Girard | 280/615 |
| 6,374,517 | B2 | 4/2002 | Girard et al. | 36/117.3 |
| 6,390,494 | B2 * | 5/2002 | Gignoux et al. | 280/615 |
| 6,402,184 | B1 * | 6/2002 | Hauglin | 280/615 |
| 6,409,204 | B1 * | 6/2002 | Ayliffe | 280/613 |
| 6,435,537 | B2 | 8/2002 | Veux | 280/615 |
| 6,499,761 | B1 * | 12/2002 | Quellais | 280/623 |
| 6,685,213 | B2 * | 2/2004 | Hauglin | 280/624 |
| 6,957,827 | B2 * | 10/2005 | Kogler | 280/613 |
| 6,964,428 | B2 * | 11/2005 | Quellais et al. | 280/615 |
| 2003/0168830 | A1 | 9/2003 | Haughlin | 280/615 |

FOREIGN PATENT DOCUMENTS

| | | |
|---|---|---|
| EP | 0768103 | 4/1997 |
| EP | 0890379 | 1/1999 |
| EP | 0914844 | 5/1999 |
| FR | 2363341 | 9/1976 |
| FR | 2642980 | 2/1989 |
| FR | 2634132 | 1/1990 |
| FR | 2650192 | 2/1991 |
| WO | WO96/37269 | 11/1996 |
| WO | WO99/02226 | 1/1999 |
| WO | WO00/13755 | 3/2000 |
| WO | WO01/93963 | 12/2001 |

* cited by examiner

DEVICE FOR BINDING A BOOT TO A SPORTS ARTICLE

CROSS-REFERENCE TO RELATED APPLICATIONS

This application is a continuation of U.S. patent application Ser. No. 10/759,211, filed on Jan. 20, 2004 now U.S. Pat. No. 6,964,428, the disclosure of which is hereby incorporated-by-reference thereto in its entirety and the priority of which is claimed under 35 U.S.C. 120.

This application is based upon French Patent Application No. 03.00811, filed Jan. 21, 2003, the disclosure of which is hereby incorporated by reference thereto in its entirety and the priority of which is hereby claimed under 35 U.S.C. 119.

BACKGROUND OF THE INVENTION

1. Field of the Invention

The invention relates to a device for binding a boot, i.e., a boot or a shoe, to a sports article, particularly to a gliding apparatus such as a skate or a ski.

More particularly, the invention relates to devices for binding a boot onto a ski. For example, the invention can be implemented for the design and construction of bindings for cross-country skiing, alpine or cross-country skiing, mountain skiing, and Telemark skiing.

2. Description of Background and Relevant Information

As a first example of a binding of the aforementioned type is that of "hinge-type" cross-country ski bindings marketed by the assignee Salomon S. A. under the trademark "SNS PROFIL." Another binding of the aforementioned type is that described in the document EP 768 103 and in U.S. Pat. No. 6,017,050, and which is found on certain cross-country ski binding devices marketed by the assignee under the trademark "SNS PILOT." In both cases, the boot is articulated at its front end about a transverse axis in relation to the ski, which is provided by a retaining system forming a jaw in which a pivot rod affixed to the boot sole is received. The two systems differ by the design of the systems for the elastic return of the boot to a low position.

The invention can also be applied to a device such as described in the document WO 00/13755 and U.S. Pat. No. 6,499,761, which boot retaining system is improved with respect to the prior binding systems. Indeed, the foot movement in relation to the ski, controlled by the retaining system when the heel is raised, is no longer a mere rotation and, instead, approximates a natural foot rolling movement as closely as possible. A device of the same type, more specifically dedicated to alpine cross-country skiing or Telemark skiing, is described in the patent publication EP 890 379. The principle of these devices is to allow a binding of the boot on the ski that is completely rigid in torsion, but which enables the heel of the boot to be raised freely.

The invention can also be implemented for binding devices of the types described in the documents WO 96/37269, EP 914 44, and WO 01/93963, as well as in respective family member documents U.S. Pat. No. 6,113,111, U.S. Pat. No. 6,152,458, and U.S. patent application Publication No. 2003/0168830 A1.

SUMMARY OF THE INVENTION

An object of the invention is to improve upon all of the aforementioned types of bindings having in common a system for retaining the boot that is independent of an elastic return system. Indeed, particularly for cross-country skiing, it is necessary for the binding to have an elastic return system that returns the boot to the low position corresponding to its position when it is supported at the front and rear on the ski. This elastic return system must be sufficiently powerful to return the boot quickly to this low position. For example, when performing the skating step in cross-country skiing, this return occurs when, at the end of the thrust, the skier wishes to return the ski toward the front by lifting it from the snow. In this case, it appears that it is the front of the ski that the return system must return toward the top in relation to the position of the user's boot. If the return is not sufficiently powerful, the front end of the ski will be slow to rise and will run the risk of catching the snow, thus seriously disturbing the skier's progression. However, this elastic return system must also allow for a good progressive increase in the force depending upon the lift angle of the connecting member, and its action must not oppose too much resistance to the rolling movement of the foot.

Another requirement that the elastic return system must meet is not to be too bulky or too heavy.

In addition, with respect to construction, the elastic return system must be completely integrated into the remainder of the binding device.

The bindings to which the invention applies are distinguished from cable bindings of the type described, for example, in the documents U.S. Pat. No. 3,863,942, WO 99/02226, FR 2 363 341, and U.S. Pat. No. 3,844,575. These cable bindings are generally adapted for alpine or Telemark skiing. In any case, they have an abutment arranged at the front, as well as a cable that is adapted to wind around the rear portion of the boot and to be tensioned in order to push the boot forward in support against the abutment. Although the cable can possibly cause an elastic return effect, this is not the primary effect desired and, generally speaking, it only occurs at the end of the boot flexion range. Indeed, the cable primarily serves as a member for retaining the boot within the retaining system constituted by the abutment and the cable. In this way, because the cable is primarily designed for its retaining function, the return is generally arranged near the boot flexion point, which is approximately the center of rotation of the boot heel movement in relation to the ski. As a result, because the return is arranged substantially in the area of this center of rotation, the cable only transmits a small displacement to the spring, and the variation in this displacement with respect to the angular position of the heel varies only slightly, and, in addition, this variation is not actually controlled. In this way, the variation in the return force cannot be completely controlled. For certain positions of the boot, the return force can be almost zero, even negative. It has been noted that it is not possible to have this control when the retaining system and the elastic return system are not independent, as in the cable bindings of the prior art in which, without the cable, the boot is no longer retained on the ski.

In order to overcome these various drawbacks, the invention proposes a device for binding a boot to a sports article, of the type having a retaining system whereby the boot is fixed to the ski with a possibility of being displaced in relation to the sports article, between a low position and a high position; of the type having a system for the elastic return of the boot to its low position; and of the type in which the retaining system is independent of the elastic return system, wherein the elastic return systems has at least:

an elastic member that is connected to the sports article; and a flexible linkage that connects the elastic member directly or indirectly to the boot, and which cooperates with at least one return member.

BRIEF DESCRIPTION OF DRAWINGS

Other features and advantages of the invention will become apparent from the following detailed description, with reference to the attached drawings, in which.

DETAILED DESCRIPTION OF THE INVENTION

The invention will be described here with respect to the embodiments in which the binding device is more particularly adapted to cross-country skiing. However, as noted above, cross-country skiing is merely exemplary of the fields of endeavor to which the invention is intended to encompass.

Figure 1:
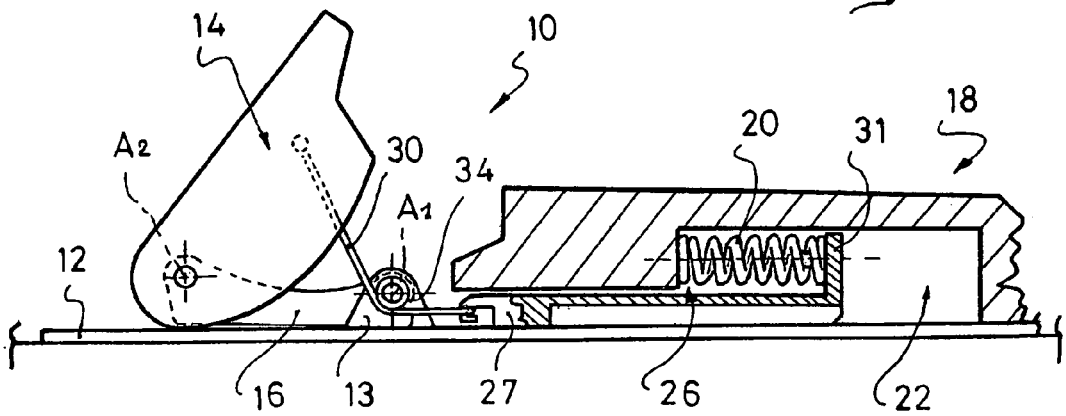
FIG. 1 is a schematic side view of a first embodiment of a binding device according to the teachings of the invention, shown in the high position.
Figure 2:
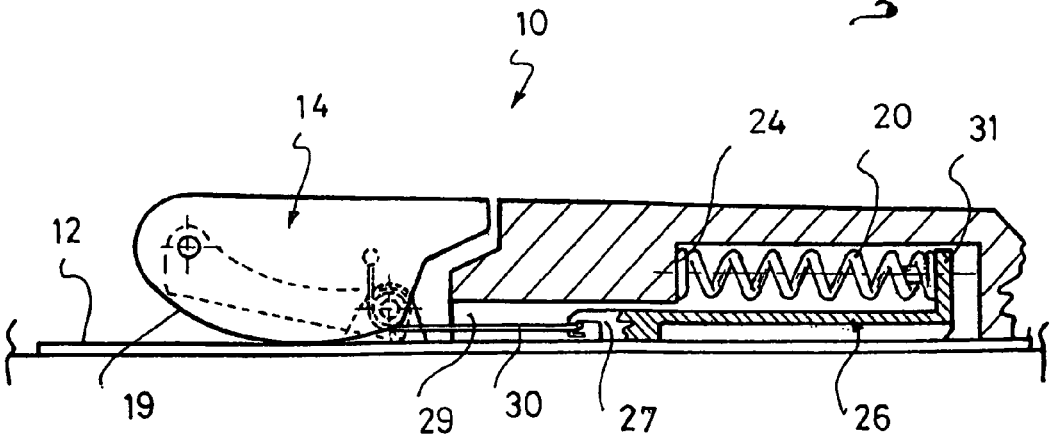
FIG. 2 is a schematic side view of the device of FIG. 1 shown in the low position.
Figure 3:
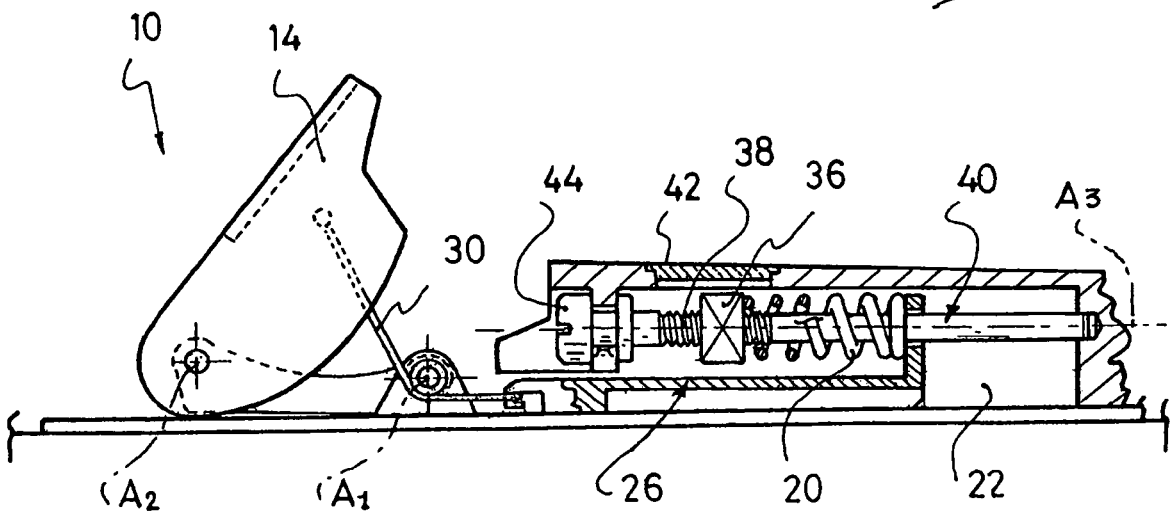
FIG. 3 is a view, similar to that of FIG. 1, showing a variation of the first embodiment of the invention.
Figure 4:
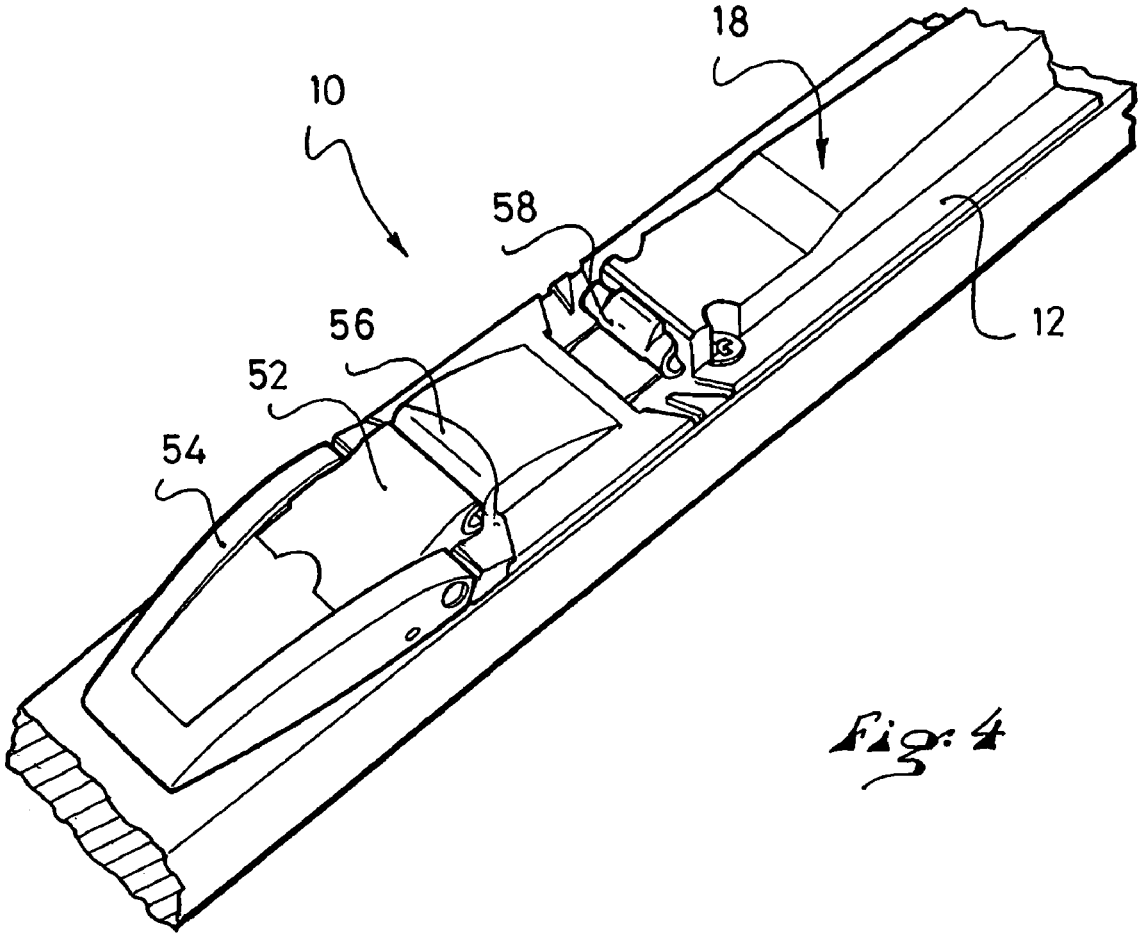
FIG. 4 is a perspective schematic view of a second embodiment of the invention.

The first embodiment of a binding device 10 shown in FIGS. 1-3 has a base 12 that is adapted to be fixed to a sports article (not shown), such as a ski or skate, as described above, but which could also be incorporated directly therein as an insert or be unitary with a component thereof. In this first embodiment, the binding device 10 has a connecting member 14 on which a boot is adapted to be connected or integrated, such as by screws, rivets, or by being part of an insert for a sole of the boot or by being made unitary with the sole. This connection can be manifested by a detachable interface system, which could take the form of a "step-in" type interface system in which the connection of the boot on the connecting member 14 occurs automatically, for example, by a mere contact between the two. The disconnection can possibly require manual intervention by the user.

As described in the document WO 00/13755 and U.S. Pat. No. 6,499,761, the disclosure of the latter of which is hereby incorporated by reference thereto in its entirety, particularly for a general understanding of the operation of such a binding, the connecting member 14 is provided to be fixed beneath the front portion of the boot, and to move between a low position shown in FIG. 2 (the connecting member, as well as the boot that is attached thereto, is then substantially horizontal) and a high position shown in FIG. 1, when the user's heel is raised in relation to the sports article.

The connecting member 14 is connected to the base by a rocker bar 16 that is rotationally mounted about two transverse axes A1 and A2, possibly in the form of respective pins, on a block 13, or projection, of the base 12, on the one hand, and on the connecting member 14, on the other hand.

In the example shown, the rocker bar 16 is articulated by its rear end (with respect to the direction of the sports article) on the base 12, and by its front end on the front end of the connecting member 14, such that in the low position, the rocker bar and the connecting member are nested with respect to one another.

To this end, one can provide, for example, that the connecting member 14 be made of two parallel elements that are offset transversely and joined by spacers, the rocker bar 16 then being received between the two parallel elements. The rocker bar 16 can also be designed in the form of two parallel elements spaced apart.

One can also provide the rocker bar to be made of two parallel elements arranged on both sides of the connecting member 14. However, the invention can also be implemented by arranging the rocker bar at the front of the connecting member, i.e., by articulating it by its front end on the base and by its rear end on the front end of the connecting member.

During the lifting movement of the heel, when the connecting member 14 moves from its low position to its high position, the connecting member 14 is in support on the base by its front end which has a curved profile 19 on at least one portion. The form and development of the curved profile 19 provides for the height position of the axle A2 in relation to the base 12, depending upon the angular orientation of the connecting member. By an optimal design of the curved profile 19, and by a judicious selection of the length and of the initial angle of the rocker bar 16, one provides for the relative movement of the connecting member 14 in relation to the base 12 during the heel lifting phase. In the example shown, it can be noted that the angular movement of the rocker bar 16 is small, for example, on the order of 10-20 degrees, or approximately 10-20 degrees, when the connecting member 14 tilts over an angle of about 60 degrees, and that given the initial angle of the rocker bar, it translates into a small but actual forward displacement of the axis A2. It is noted that the lifting movement of the heel occurs due to a rolling movement with sliding of the curved profile 19 on the base 12.

The connecting member 14, the rocker bar 16, and the arrangement for connecting the boot on the connecting member are the main elements forming a retaining system whereby the boot is fixed to the sports article, and whereby the relative movement of the boot in relation to the sports article is determined. The binding device 10 also has a system for the elastic return of the boot to its low position, the retaining system being independent and distinct of the elastic return system.

According to the teachings of the invention, the elastic return system has at least one elastic member that is connected to the sports article, and a flexible linkage that connects the elastic member to the boot, and which cooperates with at least one return member. In the first embodiment shown in FIGS. 1-3, the flexible linkage is indirectly connected to the boot, in the sense that it is not directly connected on the boot, but rather it is connected to the connecting member. However, because the boot and the connecting member are in constant connection when this system is in use, this functionally leads to the same result.

In the example shown in FIGS. 1-3, the binding device 10 has a guiding ridge or rib 18 that is made of a profile having a generally parallelepipedic cross-section, and which extends longitudinally rearward, at the rear of the connecting member 14. In a manner known in cross-country bindings, for example, this guiding ridge 18 is provided to cooperate with a groove having a complementary cross-section and arranged in the boot sole to ensure a lateral guiding of the boot/binding assembly.

Advantageously, the elastic member 20 is integrated into a housing 22 arranged inside the ridge 18. In this first embodiment, the elastic member 20 comprises a compression spring that is arranged horizontally and longitudinally in the housing 22. The front end of the spring 20 is in support against a front surface 24 of the housing 22. This front end of the spring is therefore fixed. The rear end of the spring is in support against a movable carriage 26 that can slide longitudinally in relation to the base 12 and to the ridge 18. More specifically, the carriage 26 has a front end 27 that moves in the area of a front opening 29 of the housing 22, and a rear end 31 that moves in the housing 22, and on which the rear end of the spring 20 takes support.

Such an arrangement of an elastic member and of a movable carriage is similar to that found in the device described in the document EP-768 103 and in certain cross-country ski binding devices marketed by the assignee Salomon S. A. under the trademark "SNS PILOT." However, in contrast to this prior art in which the elastic member is connected to the boot by a rocker bar, the device according to the invention has a flexible linkage 30 that connects the elastic member 20 to the connecting member 14.

As can be seen in the drawing figures, the linkage 30 is not directly connected to the elastic member, but rather on the front end 27 of the carriage 26. It passes over a guide or return 34, or return member, which is constituted here of a pulley mounted on a block 13, coaxially with the rocker bar 16 about the axis A1. The return could also be constituted of a mere slide, such as curved surface. In this embodiment, the return 34 is fixed in relation to the base 12 and in relation to the sports article. The other end of the linkage 30 is connected to the connecting member 14 such that the portion of the flexible linkage 30 that extends between the return 34 and the connecting member 14 is substantially vertical, such that the return force exerted on the connecting member 14 is mainly directed downward, i.e., primarily vertical (when the upper surface of the base is considered horizontal) including when the connecting member 14 is in the high position as shown in FIG. 1. That is, as seen in FIG. 1, for example, the linkage 30 has an orientation with a greater vertical component than horizontal component. Conversely, the portion of the linkage 30 that extends from the return to the elastic member 20 extends along a substantially horizontal direction, e.g., substantially parallel with the upper surface of the base 12.

As can be seen from FIGS. 1 and 2, when the connecting member moves from its low position to its high position, the flexible linkage 30 moves lengthwise and pulls the movable carriage forward and causes the compression of the spring, which therefore provides a return force.

According to a particular embodiment, the flexible linkage is substantially inextensible. For example, this can be a metallic cable or a cable made of fibers exhibiting very low extensibility, for example, a cable made of aramid fibers. One can also envision this link to be made in the form of a strip, such as a flat strip having a width much greater than its thickness. This traction strip can be obtained, for example, in the form of a metallic strip, or of a harness of parallel fibers embedded in a polymer material. In a particular embodiment, the linkage is sufficiently supple and flexible not to produce a notable elastic effect, and in particular, to support a return having an angle of about 90 degrees. Therefore, the flexibility of the linkage 30 should be generally understood as being the flexional flexibility about the return axis. This flexibility of the link cannot be only local, because the linkage moves in relation to the return. However, particularly if the flexible linkage is a strip, this strip will not be flexible in flexion about an axis perpendicular to the plane of the strip; but this will not prevent the strip from being considered as flexible in the context of the invention if it does not offer any substantial resistance to the flexion about the return axis.

This flexibility requires that the transverse guiding of the boot be ensured by a distinct mechanism, in this case by the retaining system. In the example shown, the guiding mechanism is constituted, for example, by the rocker bar 16 and by the sliding surface 19. However, the guiding mechanism could be designed differently, for example, in the form of a mechanism having a plurality of rocker bars as described in the document WO 96/37269 and U.S. Pat. No. 6,113,111.

FIG. 3 shows a variation of the first embodiment of the invention, in which the return system according to the invention has a mechanism for adjusting the stiffness of the elastic member 20, in order to provide the user with the possibility of increasing or reducing the intensity of the elastic return force to adapt it to his type of sporting activity.

Thus, one can see that the front end of the spring is in support on an abutment 36 that is mounted in the housing, on a threaded portion 38 of a rod 40. The rod 40 is mounted in the housing 22 so as to be rotationally movable about its longitudinal axis A3; but it is stopped longitudinally in translation. Furthermore, it is seen that the rod 40 extends over the entire length of the housing 22, such that it also ensures the guiding of the spring 20 (whose helical turns wind about the rod) and of the rear end of the carriage 26 on which the spring 20 takes support. Contrary to the spring 20 and to the carriage 26 which slide freely on the rod 38, the abutment 36 is formed by a nut that is screwed on the threaded portion 38 of the rod 40, and which cannot pivot about its longitudinal axis A3. The front end of the rod 40 extends out of the housing 22 and is in the form of a screw head 44 so as to enable the user to control the rotation of the rod 40 about its axis A3. In this way, due to this screw-nut system, the user can cause the longitudinal displacement of the abutment 36 in the housing in order to cause a more or less substantial prestress of the spring 20. In the example shown, the guiding ridge 18 has a window 42 that enables the user to see the position of the abutment 36 and therefore to evaluate the spring prestress value. Graphical references can be associated with this window 42.

This elastic return system is particularly advantageous because it makes it possible to house the elastic member in a zone of the device where it does not hinder the kinematics and the foot rolling movement allowed by the binding. In this case, the elastic member is arranged toward the rear of the binding device, but it could also be provided to be arranged at the front thereof.

The elastic member is therefore generally immovable with respect to the sports article, and it is only indirectly connected to the connecting member by the flexible linkage. In addition, because the latter passes over a return, a better orientation of the direction of the return force is obtained, which follows the direction of the portion of the flexible linkage that extends between the return and the boot. This orientation is substantially parallel to that of the trajectory that the boot must follow toward its low position.

In the example shown, the spring is a compression spring, which requires the presence of the movable carriage. The invention could also be embodied as any of other types of elastic members, for example, with a traction spring, as will be described with respect to the second embodiment.

In this first embodiment, one can ascertain that the system for retaining the boot remains independent of the elastic return system, even if, in this case, the flexible linkage (which is part of the return system) is connected to the connecting member, which is primarily part of the retaining system. This independence is ascertained by the fact that, even in the absence of the return system (for example in the case of a failure/breakage of the flexible linkage or of the elastic member), the retaining system continues to ensure fully its primary function of retaining the boot.

FIGS. 4-7 show an assembly having a boot 46 and a binding device 10 according to a second embodiment of the invention.

In this case, the boot has the conventional appearance of a cross-country ski boot 46 having a flexible sole provided, on the lower surface of its sole, with a longitudinal continuous groove adapted to cooperate with a continuous guiding ridge or rib 18 of the binding device 10.

Furthermore, this boot 46 has, at its front end, a front transverse connector, in the form of a bar 48 arranged across the groove and, set back from the front bar 48, a second transverse bar 50 also arranged across the groove and located substantially in an area vertically beneath an area of the metatarso-phalangeal articulation zone of the user's foot, and at the most, at the rear limit of the first third along the length of the boot which constitutes the extreme rear limit of the metatarso-phalangeal articulation zone.

Any position of the rear transverse bar 50 is possible between the front bar 48 and the rear limit defined hereinabove.

The front bar 48 is preferably made in the form of a cylindrical rotatable rod adapted to cooperate, in a known manner, with a retaining system having a hook-shaped movable jaw 52 controlled by a lever 54, and a front edge 56 of the base constituting a fixed jaw for the rotatable latching of the boot on the sports article. The principle of such a binding device is described, for example, in the patent publication FR 2 634 132 and in U.S. Pat. No. 5,085,454, which are commonly owned, and the disclosure of the latter of which is hereby incorporated by reference in its entirety, and which binding device can have either a manual closure, or a self-latching closure. Therefore, it will not be further described.

The rear bar 50 is adapted to allow the direct connection of an elastic return system according to the invention on the sole of the boot.

Figure 6:
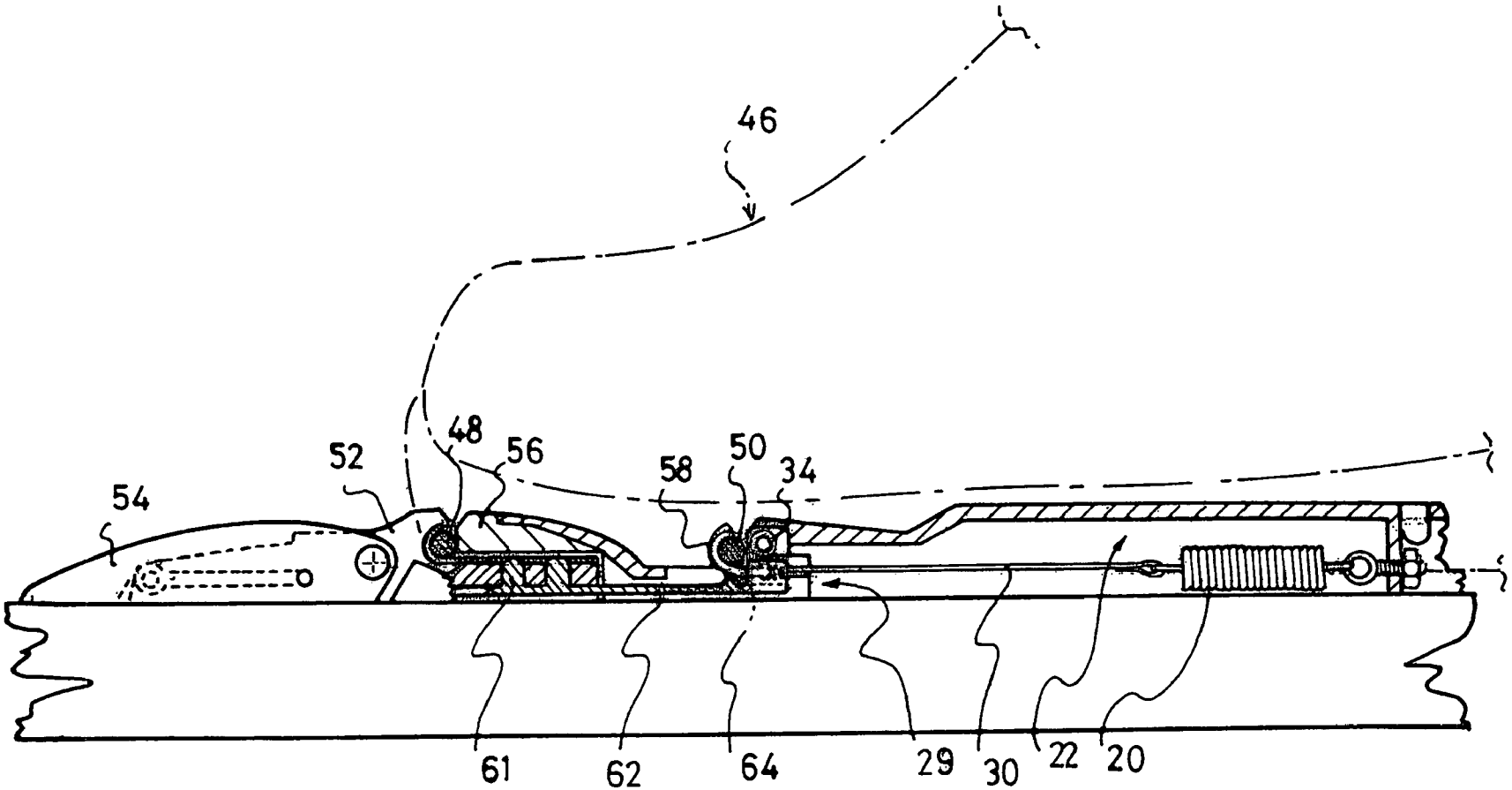
Figure 7:
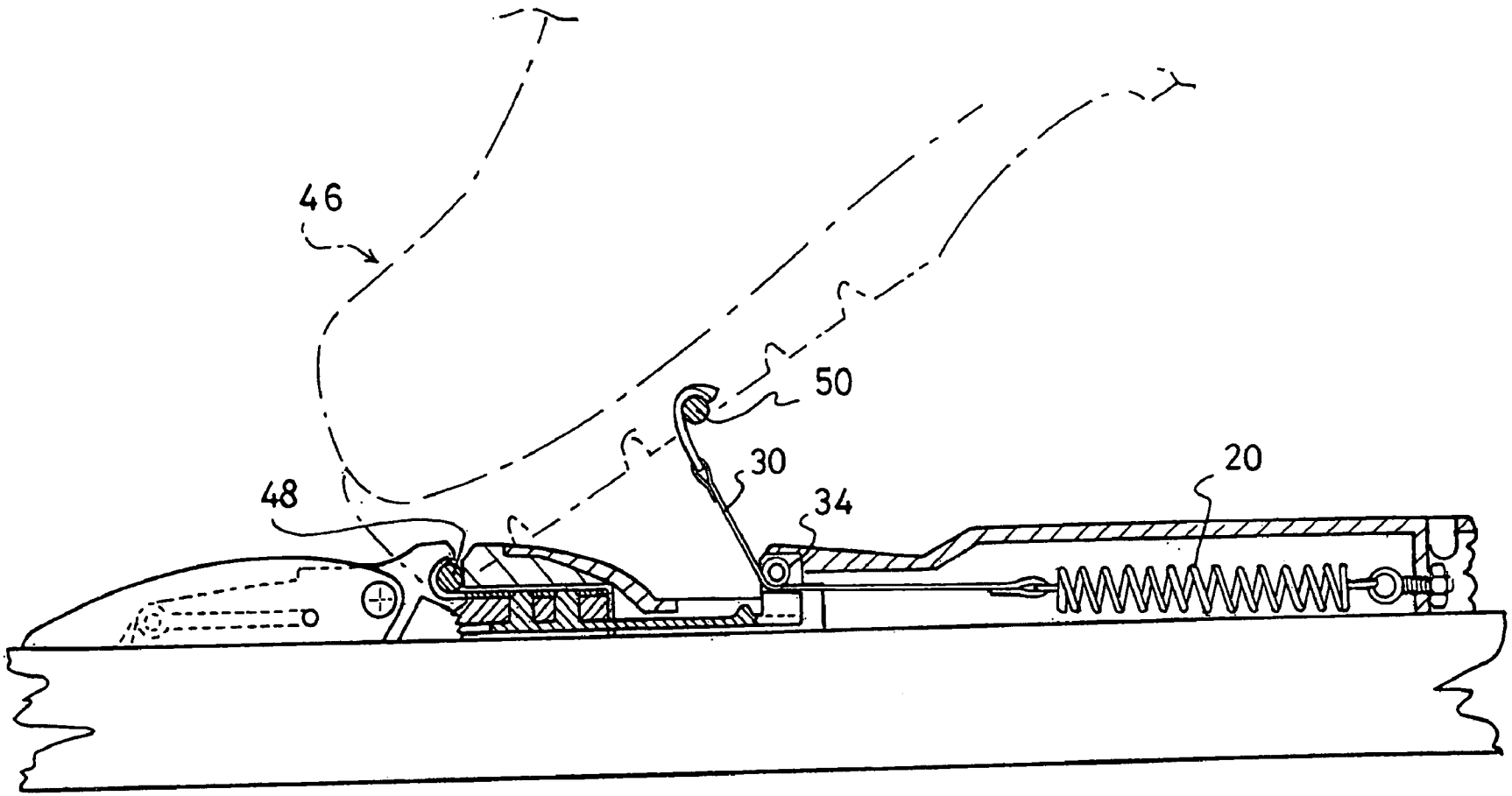

Indeed, a return system is found in this second embodiment, in which the elastic member 20, in this case, a traction spring (i.e., a tension spring), is integrated into a housing 22 arranged within a guiding ridge 18 of the device and is connected by a rear end to the base 12 of the binding device. According to the invention, the front end of the elastic member is connected to a flexible linkage 30 that extends forward. The flexible linkage is provided at its front end with a hook 58 made of metal, for example. As can be seen in FIGS. 6 and 7, the hook 58 is adapted to be connected to the rear bar 50 of the boot to ensure the connection of the elastic member 20 to the boot 46, and therefore to enable the system to ensure its function of elastic return. Therefore, the hook 58 forms a connecting member between the flexible linkage and the boot, but this connecting member is only connected to the remainder of the binding device by the flexible linkage 30.

As in the first embodiment, the flexible linkage 30 passes beneath a return 34 (for example, made in the form of a pulley or a curved surface) which is arranged here in the area of the front opening 29 of the housing 22.

One of the difficulties to overcome in implementing this principle is to allow an easy and reliable connection and disconnection of the hook 58 on the rear bar 50 of the boot. Indeed, in contrast to the prior art example of the document EP 768 103 and U.S. Pat. No. 6,017,050, the hook 58 is arranged here at the end of a flexible linkage 30 which therefore cannot, alone, ensure a precise and predetermined positioning of the hook 58 in the absence of the boot 46.

Therefore, according to another aspect of the invention, the hook 58 has a guiding portion 60 that is adapted to cooperate with complementary surfaces of the base 12 of the binding so that, when the elastic member 20 returns the hook 58 to a resting position, by means of the lengthwise movement of the flexible linkage 30, in the absence of the boot, the latter is guided and maintained in this predetermined position due to the cooperation of the guiding portion and of the associated shapes of the base. Furthermore, it is seen that the binding device also has a drawer/slide 62 which, controlled by the opening lever 54, also cooperates with the guiding portion of the hook in order to bring the hook from its resting position to a waiting position enabling the positioning of the boot.

Figure 5:
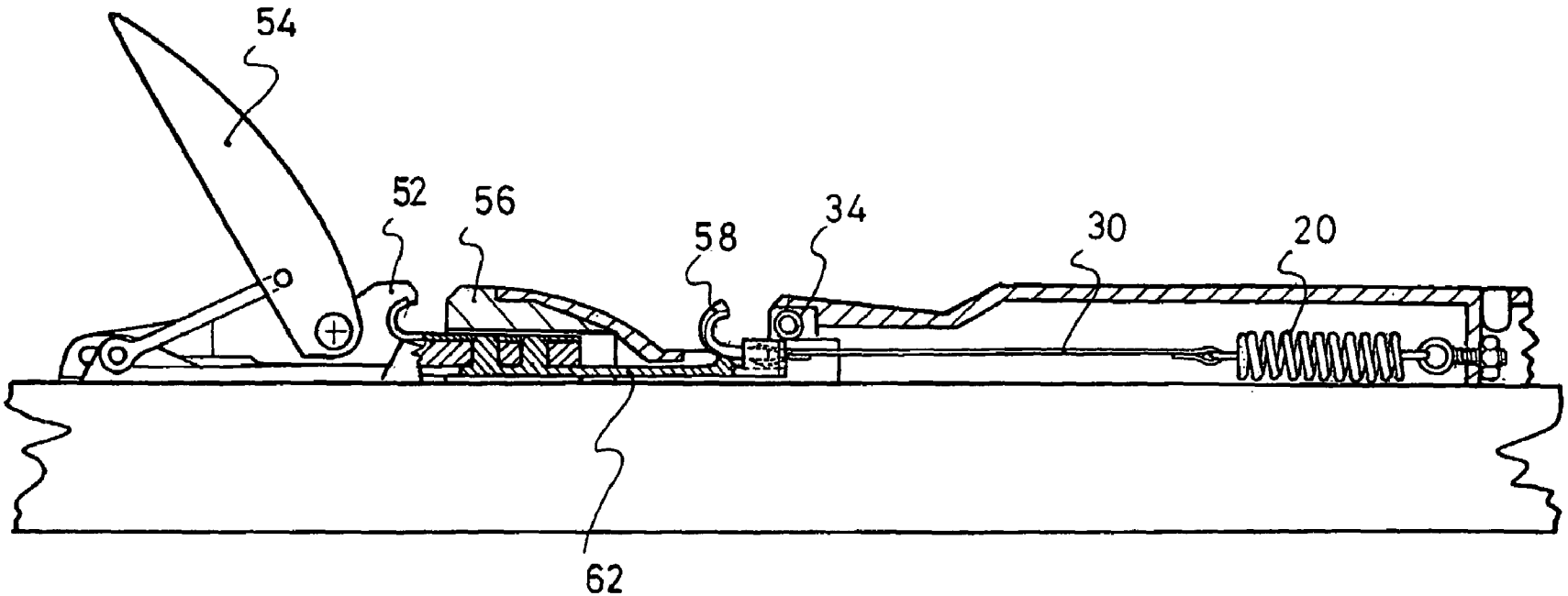
FIGS. 5, 6, and 7 are schematic views, in partial longitudinal cross-section, of the second embodiment of the invention, shown in an open state prior to fitting the boot, and in a closed state with the boot in the low position, then in the high position, respectively.
Figure 8:
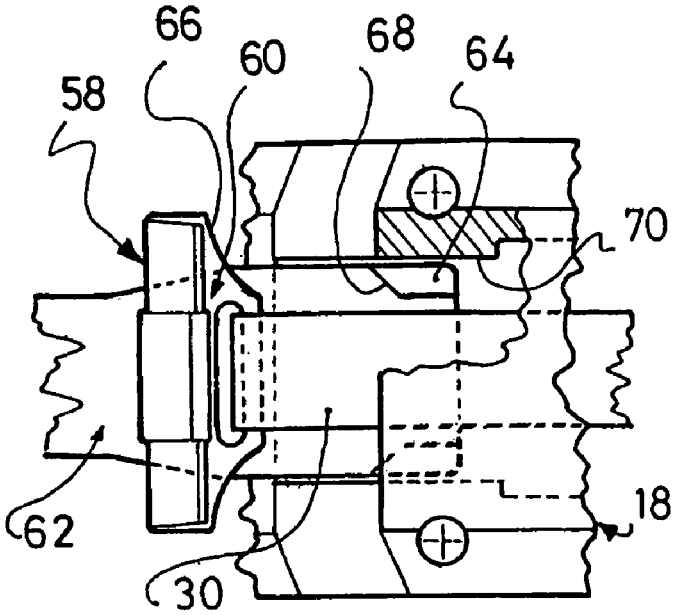
FIGS. 8 and 9 are very schematic top and side views adapted to show how, by a cooperation of complementary forms, the hook of the elastic return system of the second embodiment is systematically returned to a predetermined position.
Figure 9:
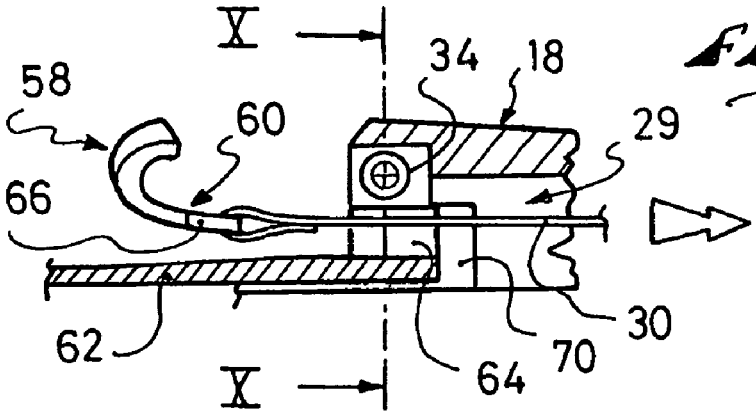
Figure 10:
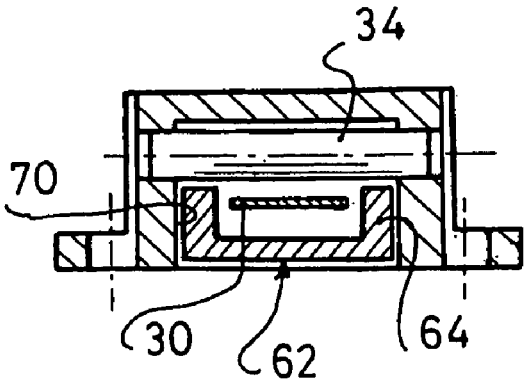
FIG. 10 is a cross-sectional view along the line X-X of FIG. 9.

Indeed, one can see in FIGS. 5-7 that the binding device has a drawer/slide 62 that is mounted to slide longitudinally on the base 12 of the binding, and whose front portion 61 is connected to the movable jaw 52 in order to follow the longitudinal movements thereof, which are controlled by the lever 54. Thus, when the lever 54 is lifted to bring the binding into an open state, it is noted that the drawer/slide 62 advances longitudinally at the same time as the movable jaw 52. However, the drawer/slide 62 has a rear portion 64 that is U-shaped in transverse cross-section and which, in the setback position of the drawer/slide 62, extends within the through opening 29 of the housing 22. With the adjacent walls 70 of this opening 29, the U-shaped rear portion 64 thus demarcates shapes complementary to the guiding portion 60 of the hook 58, as schematically shown in FIGS. 8-10. The complementary shapes can include engagement ramps 66, 68, abutment surfaces 66, or, in a non-limiting manner, lateral guiding surfaces 70.

Under the effect of the elastic member 20, the flexible linkage 30 is retracted inside the housing 22, through the opening 29 and, in the absence of the boot, it pulls the guiding portion 60 of the hook 58 along. The guiding portion is then automatically blocked against the complementary shapes of the base and of the drawer/slide, thus blocking the hook 58 in a predetermined position.

From this predetermined resting position, the hook 58 can be displaced longitudinally forward by the rear portion 64 of the drawer/slide 62 when the latter is controlled forwardly when the user lifts the lever. In this waiting position, shown in FIG. 5, the hook 58 is no longer capable of cooperating with the rear bar 50 of the boot, which can then be positioned (or instead removed). This positioning is done by engaging the front bar 48 of the sole between the two jaws 52, 54 of the hinge, then by pivoting the sole of the boot 46 downward about the axis formed by hinge. When the boot is in the low position, in support both at the front and at the rear, the rear bar 50 has reached a position in which it is capable of being engaged by the hook 58. At that moment, the user can close the binding by lowering the lever 54, which results in locking the jaws of the hinge about the front bar 48. At the same time, the drawer/slide 62 moves back and, under the return effect of the spring 20, the hook 48 moves back until it hooks on the rear bar 50 (which is not necessarily a revolving cylinder) that is interposed on its path between its waiting and return positions. The assembly is then in the situation shown in FIG. 6.

If the user raises the heel of the boot, the latter makes a rotational movement about the axis of the hinge defined by the front bar 48. At the same time, the rear bar 50 is raised along a substantially half-circle arc trajectory and, as shown in FIG. 7, drives the hook 58 along with it, which causes the expansion of the spring 20, in accordance with the same principle as that described with respect to the first embodiment.

The operation of removing the boot is carried out in reverse direction from the positioning direction. When the boot 46 is the low position, the user opens the binding by raising the lever 54, which causes the opening of the jaws 52, 56, on the one hand, and the advance of the drawer 62, on the other hand. The latter, by its rear portion 64, grips the guiding portion 60 of the hook 58 and drives the hook 58 forward, which frees the rear bar 50 from the boot.

The two embodiments of the invention provide for a return system whose return force is completely controlled, the retention and the guiding of the movement of the boot being obtained by an independent system. One can thus provide the beginning of the lifting to be carried out with little initial return force, then to program the development curve of this force as a function of the lifting angle of the boot. To this end, the elastic member can be constituted of a plurality of serial and/or parallel springs, and/or it can also incorporate elastomeric elements having another type of force/deformation curve.

Furthermore, in any case, the elastic return system can be completed by other elastic systems or abutment systems.

Figure 11:
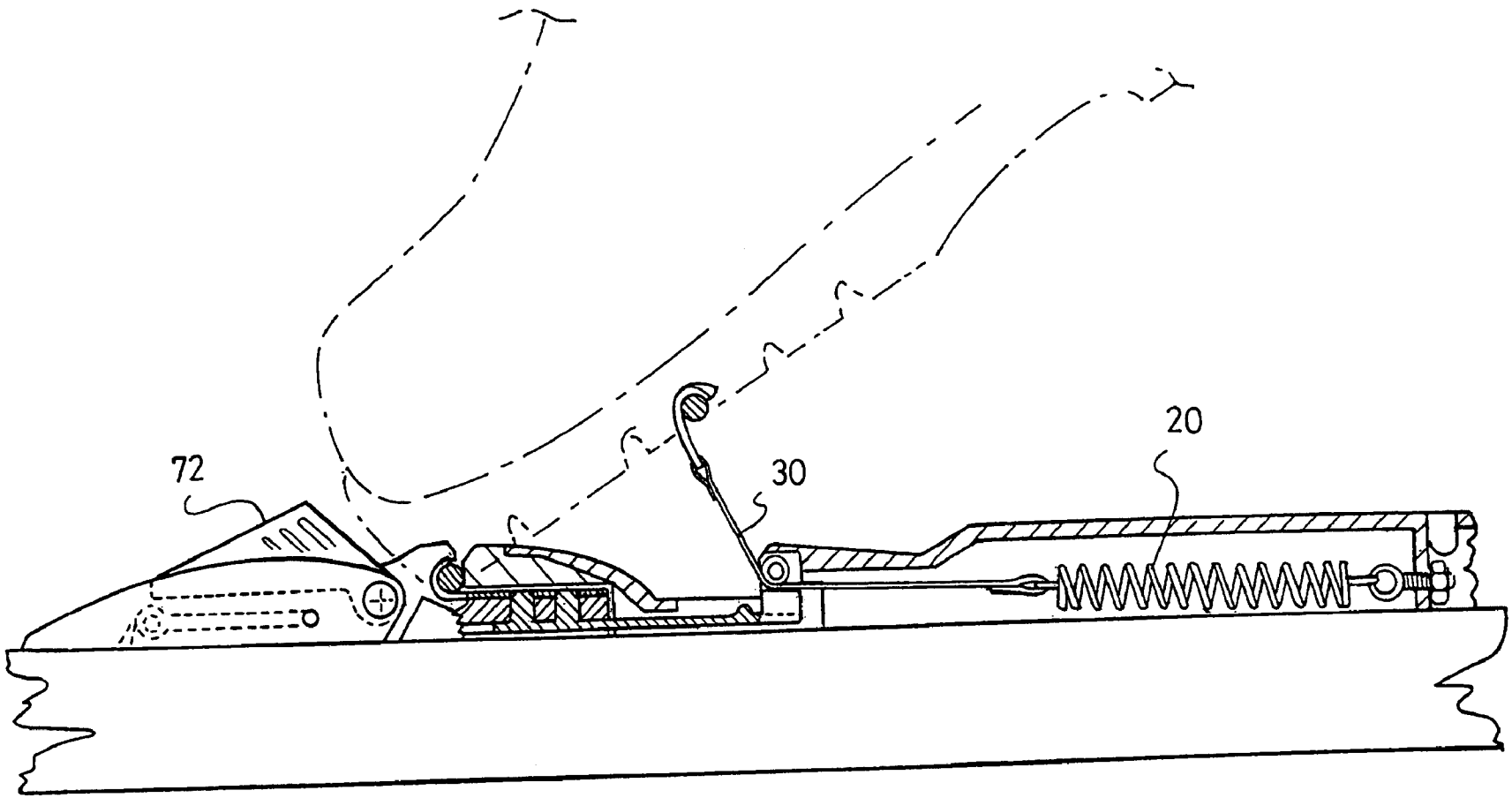
FIG. 11 is a view, similar to that of FIG. 7, showing an alternative embodiment of the invention incorporating an elastic abutment at the end of the boot travel.

Thus, one can provide a limit abutment 72, as shown in FIG. 11, which cooperates only at a predetermined lifting angle of the boot. This abutment 72 can be a rigid abutment that limits the travel of the boot, or an elastic abutment obtained in the form of an elastic buffer of the type described in the document FR 2 650 192 and in U.S. Pat. No. 5,152,546, the disclosure of the latter of which is incorporated by reference thereto in its entirety, which will then provide a flexible abutment effect and an additional elastic return force at the same time. The abutment 72, whether rigid or elastic, can cooperate directly with the boot or with a portion of the retaining system, such as the connecting member 14 of the retaining device. In the illustrated form of the embodiment of FIG. 11, the abutment 72 is positioned at a front end portion of the binding device and, when the boot is in the low position and, until the rear of the boot reaches a predetermined lifting angle, the abutment 72 is spaced from a front end of the boot.

In the embodiments shown in the drawing figures, the guiding ridge 18 is integrated into the base 12. However, one can provide that the guiding ridge be directly integrated into the sports article, for example, to the ski. In this case, the housing 22, and the spring 20 (and, if necessary, the carriage 26) can be directly integrated into the sports article. Advantageously, this elastic return system can have a width on the order of 15-20 millimeters and can be completely integrated into the sole of the boot, so as to be housed, for example, in the space required by the groove that is found beneath the soles of cross-country skis.

Furthermore, one can see that, in all of the embodiments shown, the return 34 is arranged at a short distance from the end of the flexible linkage that is connected to the boot (possibly by means of the connecting member), this being considered with the boot in the low position. The horizontal projection of this distance is preferably less than 3 centimeters, and even more preferably less than 2 centimeters. This proximity ensures that the effective return direction (which is the direction of the portion of the link that extends between the boot and the return) remains as close as possible to a parallel to the direction of the relative movement of the boot with respect the sports article (or close to the direction of a tangent to the trajectory of the boot, which is equivalent). Furthermore, both the end of the flexible linkage connected to the boot and the return are preferably arranged in an area vertically beneath the vicinity of the metatarsophalangeal articulation zone of the user's foot when the boot is in the low position.

Moreover, particularly in the cases where the boot retaining and guiding system determines a relative movement of the boot with respect to the sports article, which is a rotational movement or similar movement (as the second embodiment shown here), one must provide to arrange the return at a certain distance from the center of this rotational movement, otherwise the movement of the boot will cause only a slight displacement or no displacement of the end of the linkage that is connected to the elastic member, rendering the return system inefficient.

The invention claimed is:

1. A device for binding a cross-country ski boot to a cross-country ski, said binding device comprising:

a retaining system adapted to connect a front of the boot to the ski, the binding device allowing a rear of the boot to be moved in relation to the ski between a low position and a high position;

an elastic return system for applying an elastic return force to the boot to move the rear of the boot toward the low position during skiing; and an elastic abutment which operates to oppose movement toward the high position only after the rear of the boot has moved away from the ski through a predetermined lifting angle.

2. A binding device according to claim 1, wherein:

the elastic abutment provides an elastically compressible abutment effect and an elastic return force for the boot additional to said elastic return force of said elastic return system.

3. A binding device according to claim 1, wherein:

the elastic abutment comprises an elastically compressible buffer.

4. A binding device according to claim 1, wherein:

the elastic abutment cooperates directly with the boot.

5. A binding device according to claim 1, wherein:

the elastic abutment cooperates with a portion of the retaining system.

6. A binding device according to claim 1, wherein:

the elastic return system comprises an elastic member and a mechanism for adjusting a stiffness of the elastic member.

7. A binding device according to claim 1, wherein:

the elastic abutment is positioned at a front end portion of the binding device, spaced apart from said elastic return system, and, when the boot is engaged in the binding device, in front of the boot.

8. A binding device according to claim 1, wherein:
the elastic abutment is positioned at a front end portion of the binding device and spaced from a front of the boot when the boot is engaged in the binding device in the low position.

9. A binding device according to claim 1, wherein:
the elastic return system comprises a component adapted to be connected, during connection of the front of the boot to the ski, to a part of the boot spaced forwardly from a rear end of an external sole of the boot to apply said elastic return force of the elastic return system to said part of the boot.

10. A binding device according to claim 9, wherein:
the elastic return system comprises a component adapted to be connected, during connection of the front of the boot to the ski to the retaining system, to a part of the boot corresponding to a metatarso-phalangeal articulation zone of a user's foot to apply said elastic return force of the elastic return system to said part of the boot.

11. A binding device according to claim 10, wherein:
said elastic return force of the elastic return system is applied substantially perpendicularly downward relative to a lower surface of an external sole of the boot.

12. A binding device according to claim 1, further comprising:
a guiding ridge adapted to engage in a longitudinally extending groove in a sole of the cross-country boot.

13. A binding device according to claim 12, wherein:
the elastic return system comprises an elastic member; and
the elastic member is integrated into a housing inside the guiding ridge.

14. A binding device for binding a cross-country ski boot to a cross-country ski, said binding device comprising:
a retaining system adapted to connect a front of the boot to the ski, the binding device allowing a rear of the boot to be moved in relation to the ski between a low position and a high position;
an elastic return system for applying an elastic return force to the boot to move the rear of the boot toward the low position during skiing; and
an elastic abutment which operates to oppose movement toward the high position only after the rear of the boot has moved away from the ski through a predetermined lifting angle;
the retaining system being independent of the elastic return system; and
the elastic return system comprising at least one substantially inextensible flexible linkage.

15. A device for binding a cross-country ski boot to a cross-country ski, said binding device comprising:
a retaining system adapted to connect a front of the boot to the ski, the binding device allowing a rear of the boot to be moved in relation to the ski between a low position and a high position;
an elastic return system for applying an elastic return force to the boot to move the rear of the boot toward the low position during skiing;
an elastic abutment which operates to oppose movement toward the high position only after the rear of the boot has moved away from the ski through a predetermined lifting angle;
said elastic abutment is operably connected to said elastic return system via the boot, the elastic abutment applying an elastic return force to the front the boot and the elastic return system applying an elastic return force to a part of the boot rearward of the front of the boot and forward of the rear of the boot.

16. A binding device according to claim 15, wherein:
said elastic abutment comprises an elastically compressible abutment.

17. A binding device according to claim 15, wherein:
said elastic return force of the elastic return system is applied substantially perpendicularly downward relative to a lower surface of an external sole of the boot.

18. A binding device according to claim 15, wherein:
the elastic return system comprises a component adapted to be connected, during connection of the front of the boot to the ski to the retaining system, to a part of the boot corresponding to a metatarso-phalangeal articulation zone of a user's foot to apply said elastic return force of the elastic return system to said part of the boot perpendicularly downward relative to a lower surface of an external sole of the boot.

19. A binding device according to claim 15, wherein:
the elastic return system comprises at least one substantially inextensible flexible linkage.

20. A device for binding a cross-country ski boot to a cross-country ski, said binding device comprising:
a retaining system adapted to connect a front of the boot to the ski, the binding device allowing a rear of the boot to be moved in relation to the ski between a low position and a high position;
an elastic return system for applying an elastic return force to the boot to move the rear of the boot toward the low position during skiing; and
a limit abutment positioned to cooperate directly with the boot, or to cooperate with a portion of the retaining system for the boot, only after the retaining system has allowed the boot to move away from the ski through a predetermined lifting angle, said limit abutment being effective to end movement of the boot in a direction away from the ski.

21. A binding device according to claim 20, wherein:
the limit abutment is an elastic abutment.

22. A binding device according to claim 20, wherein:
the limit abutment is a rigid abutment.

23. A binding device according to claim 20, wherein:
the limit abutment is a rigid abutment which operates to oppose movement away from the ski only at a predetermined lifting angle of the boot at the end of the travel of the boot.

24. A binding device according to claim 20, wherein:
the limit abutment cooperates directly with the boot.

25. A binding device according to claim 20, wherein:
the limit abutment cooperates with a portion of the retaining system.

26. A binding device according to claim 20, wherein:
the limit abutment is positioned at a front end portion of the binding device, spaced apart from said elastic return system, and, when the boot is engaged in the binding device, in front of the boot.

27. A binding device according to claim 20, wherein:
the limit abutment is positioned at a front end portion of the binding device and spaced from a front of the boot when the boot is engaged in the binding device in the low position.

28. A binding device according to claim 20, wherein:
the elastic return system comprises a component adapted to be connected, during connection of the front of the boot to the ski, to a part of the boot spaced forwardly from a rear end of an external sole of the boot to apply said elastic return force of the elastic return system to said part of the boot.

29. A binding device according to claim 28, wherein:

the elastic return system comprises a component adapted to be connected, during connection of the front of the boot to the ski to the retaining system, to a part of the boot corresponding to a metatarso-phalangeal articulation zone of a user's foot to apply said elastic return force of the elastic return system to said part of the boot.

30. A binding device according to claim 29, wherein:

said elastic return force of the elastic return system is applied substantially perpendicularly downward relative to a lower surface of an external sole of the boot.

31. A binding device according to claim 20, wherein:

the elastic return system comprises at least one substantially inextensible flexible linkage.

32. A binding device according to claim 20, further comprising:

a guiding ridge adapted to engage in a longitudinally extending groove in a sole of the cross-country boot when the sole is supported by an upper surface of the ski.

33. A binding device according to claim 32, wherein:

the elastic return system comprises an elastic member; and the elastic member is integrated into a housing inside the guiding ridge.

* * * * *